United States Patent [19]

Seskin

[11] 3,990,684

[45] Nov. 9, 1976

[54] MATERIALS MIXING APPARATUS

[76] Inventor: Abie Seskin, 33 Grenville Ave. Savoy Estates, Johannesburg, South Africa

[22] Filed: Mar. 28, 1974

[21] Appl. No.: 455,887

[52] U.S. Cl. ..... 259/165

[51] Int. Cl.[2] ..... B28C 7/04

[58] Field of Search ..... 259/18, 36, 152–159, 259/164, 165, 108, 151, 159 A

[56] References Cited

UNITED STATES PATENTS

| | | | |
|---|---|---|---|
| 1,330,174 | 2/1920 | DeCew | 259/18 |
| 1,332,987 | 3/1920 | Julian et al. | 259/156 |
| 1,727,340 | 9/1929 | Flory | 259/156 |
| 2,772,083 | 11/1956 | Parker | 259/158 |
| 3,101,931 | 8/1963 | Setter | 259/154 |
| 3,263,971 | 8/1966 | Farnham | 259/154 |
| 3,387,827 | 6/1968 | Carylon | 259/36 |
| 3,423,238 | 1/1969 | Weiland | 259/154 |
| 3,734,001 | 5/1973 | Poster | 99/532 |
| 3,832,201 | 8/1974 | Shearer | 259/155 |

*Primary Examiner*—Leonard D. Christian
*Assistant Examiner*—Robert Pous
*Attorney, Agent or Firm*—Broudy and Neimark

[57] ABSTRACT

This invention relates to a mobile apparatus for making aqueous bitumen and tar emulsions at road making and other surfacing sites. By providing a separate mobile storage unit for raw bitumen and mill mixing apparatus on a mobile water reservoir in which emulsifier liquid is to be made, which mill is adapted itself to draw fluid bitumen and emulsifier liquids in a pumping action, a compact and mobile plant is obtained relative to the capacity of the plant. The apparatus of the invention thus offers a feasable alternative to the transportation of ready prepared bitumen emulsions from fixed plants to distant road making sites.

17 Claims, 2 Drawing Figures

MATERIALS MIXING APPARATUS

Figure 1:
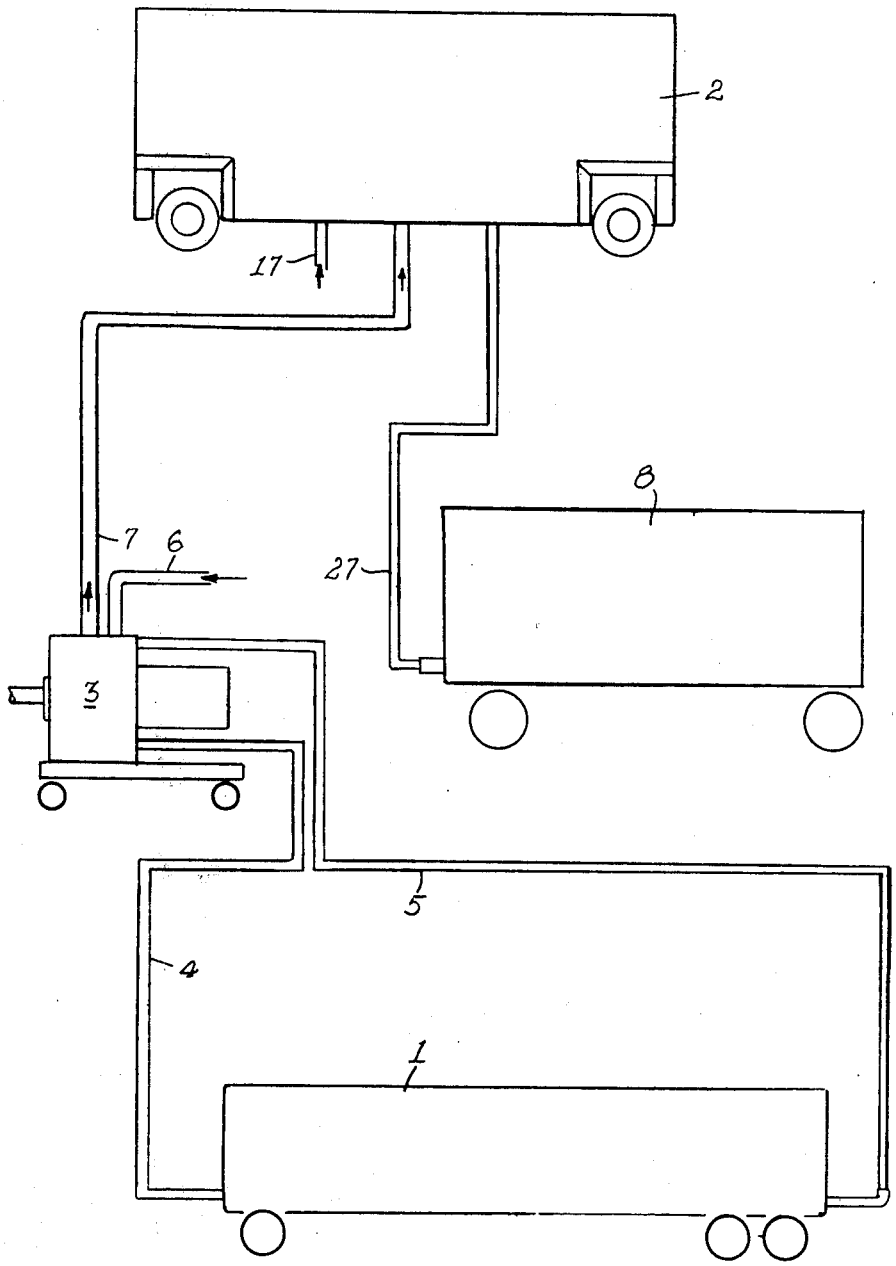

This invention relates to materials mixing equipment. More particularly the invention is concerned with apparatus for the manufacture of aqueous bitumen and tar emulsions useful in road and other surfacing operations. While bitumen is more common than tar as a material for use in the formation of emulsions, those skilled in the art will be capable of applying this invention equally to both materials. The term "bitumen" is therefore used in this specification to include tar.

In order to spread bitumen over a road surface it may, for certain of its applications, be formed as an emulsion with water. The emulsion is easier to handle than undiluted bitumen and after application to a road surface the emulsion breaks and the water evaporates leaving a film of bitumen as required.

Bitumen emulsions are, generally speaking, manufactured in fixed plants which involve the use of large installations such as electrically or steam heated bitumen and emulsifier solution storage tanks which are equipped with electrically driven stirrer means to keep the temperature of the viscous liquids suitably constant. It would be advantageous to be able to make the emulsion at the road making site in order to avoid the costs of transportation of the water portion of the emulsion through long distances to far flung road making sites but the bulk of the plant required to make the emulsion has prevented the development of mobile emulsion making plants. Such mobile plants as have been proposed have incorporated both a heated raw bitumen tank and an emulsifier liquid tank on the mobile platform together with a gravity feed of the emulsifier liquid and bitumen components to mixing apparatus. Alternatively, separate pumping means were suggested to transport the components to a mixing zone, and as a result the prior mobile plants are generally so limited as to capacity and indeed effective mobility that they have not been successful commercially.

It is an object of the invention to provide a mobile aqueous bitumen emulsion making plant which is relatively compact in relation to its capacity and which may be transported from site to site for the manufacture of bitumen emulsions without concern as to problems of the supply of electricity.

According to the invention bitumen emulsion making apparatus comprises a supporting platform, land wheels for the platform to permit the apparatus to be transported, at least one water reservoir on the platform, means to effect a mixing action between water and emulsifying agents in the reservoir, mill or like means on the platform which is adapted to draw fluid bitumen from a supply thereof and aqueous emulsifier liquid from the reservoir by a pumping action to form an emulsion of the two, prime mover means on the platform for driving the mill, and a coupling member for releasably connecting the mill to an external supply of heated bitumen.

Preferably the prime mover comprises an internal combustion engine. For example a diesel or petrol driven engine may be used so that the apparatus is independent of an electrical supply.

A feature of the mobile emulsion making plant of the invention resides in the provision of a separate bitumen storage unit so that relatively large quantities of bitumen may be stored at the road making site, and in the use of an emulsion making mill, on the mobile emulsion making platform, which is adapted to act as a pump in drawing its supply of bitumen from the external supply source. Thus a mill of the kind referred to in the art as a "Hurrell" mill may be employed, such mill drawing metered quantites of bitumen and emulsifier from supplies thereof by its own pumping action.

Also according to the invention the apparatus includes at least two water reservoirs, means to connect a first one of such reservoirs to the mill, means to connect the further reservoir or reservoirs to such first reservoir and pump means, powered by the prime mover, for pumping aqueous emulsifier solution from the further reservoirs to such first reservoir.

Preferably there are three water reservoirs, a first one of such reservoirs, which is connected to the mill, being located substantially centrally on the platform and the two further reservoirs flanking the first reservoir being located respectively fore and aft on the platform. Preferably also pump means is associated with the first reservoir to permit the pumping of aqueous emulsifier liquid therein back to the said further reservoir or reservoirs.

Further according to the invention the apparatus includes pump means associated with the or each reservoir in an arrangement adapted to circulate solution within the reservoir so as to effect a mixing action therein. Thus the preferred working arrangement includes a main hydraulic pump means driven by the prime mover and a sump for pressurized hydraulic fluid associated with the main hydraulic pump, the pumps associated with the reservoirs being driven by hydraulic fluid from the sump. It will be appreciated that this arrangmeet obviates the necessity for mechanical stirrers, since stirring is accomplished hydraulically by pump means all driven indirectly by the primer mover which is independent of an electrical supply. It is thus possible to provide relatively compact emulsion making apparatus which can economically be mounted on a trailer for the manufacture of bitumen emulsions at a road making site.

Figure 2:
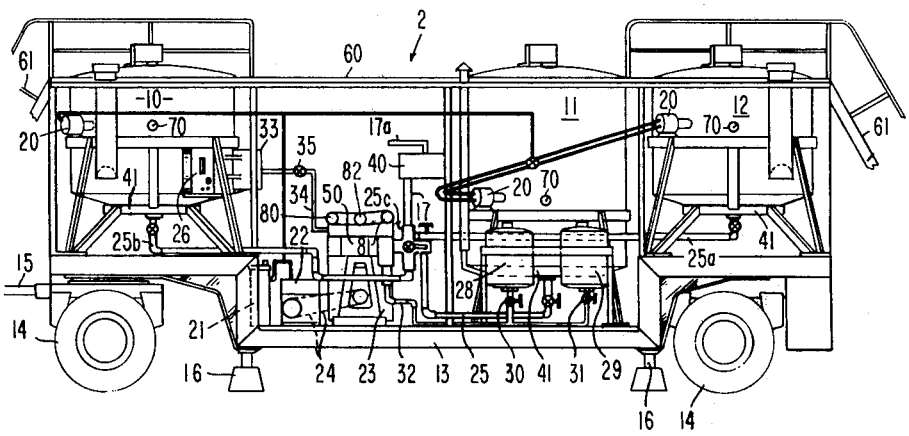

Further aspects of the invention will become apparent from the following example which is given in order to illustrate the invention with refernce to the accompanying drawings in which:

FIG. 1 is a flow sheet of the bitumen from raw bitumen supply to emulsion storage; and FIG. 2 is a diagrammatic side view of the emulsion making apparatus of the invention.

Referring to FIG. 1 of the drawings, raw bitumen is transported from a prime industrial supply source and pumped into a suitable mobile reservoir in the form of tanker 1 equipped with gas burner heating elements (not shown). The tanker 1 is located close to the mobile emulsion forming unit 2 which is situated at a suitable camp site for convenient access by emulsion sprayer or slurry vehicles.

At the commencement of the emulsion forming operation raw bitumen in the tanker 1 is circulated in a ring main by means of a pump 3, equipped with a suitable multiple valve system and a diesel driven engine, until the heating elements within the tanker have raised the temperature of the entire mass of bitumen to between 255° and 290° F dependng on the grade of bitumen used. During this preheating stage mobile bitumen is withdrawn via line 4 and returned via line 5 so that a continual flow of the viscous liquid over the heating elements is obtained with little danger of the formation of cold or hot pockets of material. The pump 3 may also be used to withdraw raw bitumen from a supply vehicle via line 6 when tanker 1 is to be filled.

When the temperature of the raw bitumen in tanker 1 is satisfactory and when emulsifier solution has been prepared in the emulsifier unit 2, as will be discussed below, the pump 3 is shut down and the valve associated with the pump 3 is switched to enable mobile raw bitumen to be withdrawn from the tanker 1 via line 7. This bitumen is then formed into an aqeuous emulsion in the emulsifier unit 2 as will be described hereunder and the emulsion is passed directly to a static or reservoir tank 8 from where it may be withdrawn by the emulsion sprayer units as required.

Referring now also to FIG. 2, while the the raw bitumen in tank 1 is being heated emulsifier solution may be prepared in tanks 10, 11 and 12 of the unit 2. The latter comprises a chassis 13 which provides a platform equipped with road wheels 14 front and rear and a draw bar 15 so that the unit may be coupled to a mechanical horse for transportation to a desired site. When emulsion making operations are in progress the suspension of the trailer unit 2 is likely to be overtaxed due to the load carried and the chassis is therefore provided with drop legs 16 which operate as jacks so that at least a portion of the load may be transferred via the legs directly to the chassis.

At the start up of operations, water from any suitable reservoir is pumped, via line 17*a* to a water softening unit 40, into one or another of the tanks 10, 11 and 12 via line 17. The water is passed firstly through an ion exchange unit to soften the water by removal of calcium and magnesium compounds and thereafter it passes to the tanks 10, 11 and 12 where it is heated to between 85° and 95° C in tanks 10 and 12 and 30° and 40° C in tank 11, by gas burner means 41, the temperature in tanks 10, 11 and 12 being indicated by thermometers 70. To the body of water in each of the concentrate tanks 10 and 12 there is added suitable emulsifiers and chemicals for the formation of aqueous emulsifier concentrate to manufacture all grades of either cationic or anioic bitumen emulsions. In order to prevent excessive heat losses from the tanks 10, 11 and 12 during cold months, the tanks are provided with suitable lagging.

It is necessary in each of the concentrate tanks 10 and 12 as well as in the single strength emulsifier or dilute tank 11, as it may be termed, to mix the contents thoroughly. This in the past has been accomplished in bulky fixed installations by mechanically driven stirrers. In the emulsifier unit of the invention, however, mixing is accomplished by a circulatory fluid movement within the emulsifier tanks. Thus each of the tanks is equipped with a pump 20 adapted to withdraw fluid from and inject it tangentially into the tank. In this way a stirring motion is obtained but in case even this is inadequate the tanks are interconnected via lines 25, 25*a* and 25*b* and movement of the fluid from one tank to another by means of pump 22 via valve 25*c* is possible. Thus if the tank 11 still contains some cationic emulsifier solution say when it becomes necessary immediately to commence making of an anionic emulsifier solution it is not necessary to discard the residual amount of cationic emulsifier since this can be pumped into an empty concentrate tank 10 or 12 until it is to be used again. The pumps 20 are powered by hydraulic fluid derived from a pressure tank 21 which in turn is supplied by main pump 22 by a diesel engine 23 through a belt 24. It will thus be appreciated that the operation is effected without the need for electrical energy which may not be readily available at road construction sites where the unit 2 is situated.

When thorough mixing has been attained and the necessary chemical reaction completed in the concentrated emulsifier solution in either tank 10 or 12 the concentrate may be pumped into the dilute tank 11 where it is mixed with further water to produce the correct strength emulsifier. When the temperature of the emulsifier in the dilute tank 11 is between 30° and 40° C the emulsion making operation can be commenced.

Mounted over the diesel engine for operation thereby is a mill 50 of the kind shown in the art as a Hurrell mill. This mill is adapted to draw raw bitumen from the tanker 1 via line 7 which is connected to the mill bitumen inlet coupling 80 and emulsifier from tank 11 via line 25 which is connected to the mill bitumen inlet coupling 81. Prior to opening valves in the appropriate lines for this purpose, however, the mill is heated by passage through a steam jacket therefor of hot water from gas heated geyser 26. Heating of the mill melts any residual bitumen deposited on the plates so that resistance to movement of these parts can be materially reduced prior to starting up the mill. Also the mill plates are heated to decrease any initial temperature differential relative to the incoming bitumen. If this is not done before the mill is started up again after shutdown substantial damage to the mill can occur.

When the mill is running it draws supplies of bitumen and emulsifier from tanks 1 and 11 as stated above, forms an emulsion of these materials and deposits the emulsion directly into static tank 8 via line 27 which is connected to the mill emulsion outlet 82. If it is desired in any way to condition the emulsion being made suitable reagents may be fed to the mill from supply tanks 28 and 29 for such reagent by opening valves 30 and 31 in lines 32 leading to the mill.

During the production of a batch of emulsion it may be necessary to prepare further emulsifier concentrate and it is accordingly useful to have two concentrate tanks which can be operated in tandem because the reactions which occur may take as much as 2 hours to complete. Thus while one tank of concentrate is being used another may be made up and mixed and allowed to stand for completion of the reaction and to be ready for use when one concentrate tank and the dilute emulsion that it produces has been used up. For example in practice, to achieve continuity of operation without stopping the mill to prepare a full batch of emulsifier in tanks 10, and 12, tank 10 may be emptied into tank 11 and thereafter only a half batch of emulsifier may be prepared in tank 10 again and topped up with the correct quantity of water when there is sufficient room in tank 11 to transfer the entire contents of tank 10 into tank 11. Half the contents of tank 12 can then be transferred to tank 10 and both tanks 10 and 12 can then be topped with the correct quantity of water. When tank 11 is sufficiently depleted the entire contents of tanks 10 and 12 is then transferred to tank 11. Thereafter the entire cycle can be restarted. In this way it is possible to operate the mill continuously without having to shut down to await completion of reaction for formation of emulsifier concentrate.

When a batch of emulsion has been completed a small quantity of solvent such as "Parafine" or "Dieselene" may be fed to the mill from a supply tank 33 connected by a line 34 to the mill by opening valve cock 35. The solvent cleans the mill plates for the next operation and although the solvent is included with the finished emulsion this is not detrimental due to the relatively small quantity of the solvent used. The solvent may also, by suitable manipulation of the valves of the apparatus, be employed to clean pump 3 and lines 4 and 7.

As stated above the emulsifier concentrate is formed by mixing suitable chemicals and emulsifiers with the water in concentrate tanks 10 and 12. These materials may simply be added to the water through manholes at the top of each tank. For this purpose a gangplank 60 equipped with access ladders 61 is provided.

It will be understood by those skilled in the art that manufacture of bitumen emulsions by the road making contractor on site gives rise to material savings in cost. Thus an emulsion normally comprises approximately 40 percent of water which has to be transported from factory to site. Much of this tranportation of mere water is now avoided and the small distances that the water has to be transported may be done by ordinary water tankers.

I claim:

1. A mobile bitumen emulsion apparatus for making aqueous bitumen emulsions at road making sites and the like, the apparatus comprising:

a supporting platform;

land wheels connected to said platform to permit the apparatus for making emulsions to be transported;

at least one reservoir for storing water and emulsifying agents supported on said platform;

mixing means attached to said at least one reservoir for mixing the water and the emulsifying agents in said reservoir to form a mixture thereof;

supply means for supplying fluid bitumen;

emulsion-making mill means supported on said platform for mixing said fluid bitumen with said water and said emulsifying agents from said reservoir thereby forming an emulsion;

coupling means connected between said reservoir and said mill means for supplying the mixture of water and emulsifying agents to said mill means;

a coupling member connected to said mill means and said supply means for supplying said fluid bitumen to said mill means; and prime mover means supported on said platform for driving said mill means.

2. The apparatus of claim 1 in which said prime mover means comprises an internal combustion engine.

3. The apparatus of claim 1 including at least two reservoirs, means to connect a first one of such reservoirs to said mill means, means to connect the further reservoir or reservoirs to such first reservoir, and pump means powered by said prime mover means for pumping aqueous emulsifier solution from the further reservoirs to such first reservoir.

4. The apparatus of claim 3 including at least two of the said further reservoirs, means connecting such further reservoirs, and pump means powered by said prime mover means and adapted to pump emulsifier solution from one of the said further reservoirs to another, as well as to the said first reservoir.

5. The apparatus of claim 4 including three reservoirs, a first one of such reservoirs, which is connected to said mill, being located substantially centrally on the platform and the two further reservoirs flanking said first reservoir being located respectively fore and aft on the platform.

6. the apparatus of claim 3 in which pump means is associated with the first reservoir to permit the pumping of aqueous emulsifier liquid therein back to the said further reservoir or reservoirs.

7. The apparatus of claim 1 including pump means associated with the or each reservoir in an arrangement adapted to circulate liquid within the reservoir so as to effect a mixing action therein.

8. The apparatus of claim 6 including main hydraulic pump means driven by the prime mover and a sump for pressurized hydraulic fluid associated with the main hydraulic pump, the pumps associated with the reservoirs being driven by hydraulic fluid from the sump.

9. The apparatus of claim 1 including gas fired burner means for heating the solution in each reservoir.

10. The apparatus of claim 1 including a gas fired geyser connected to the mill for the supply of hot water thereto.

11. The apparatus of claim 1 including at least one chemical storage tank connected to the mill for the feeding of suitable chemicals to the mill separately from bitumen and aqueous emulsifier.

12. The apparatus of claim 1 including an ion exchange column mounted on the platform for treatment of water to be introduced into the reservoirs to soften such water.

13. The apparatus of claim 1 including retractable legs adapted to support the platform when the latter is stationary.

14. The apparatus of claim 3 including a reticulation system for the reservoirs provided with a coupling member for connecting the system to a water supply, the system including valve means for directing water supply to any one of the reservoirs via the coupling.

15. The apparatus of claim 1 wherein said mill means inludes a mill outlet, and including a releasably coupling associated with the mill outlet and adapted for connection to a bitumen emulsion reservoir tank to permit the feeding of emulsion direct from the mill means to the emulsion reservoir.

16. The apparatus as claimed in claim 1 including a separate mobile raw bitumen reservoir, gas fired burner means associated with such reservoir for heating bitumen therein, pump means adapted for connection through a multiple valve system to the raw bitumen reservoir to form a ring main with such reservoir and to circulate bitumen within the reservoir until the entire mass of raw bitumen has a temperature within a suitable temperature range, and means to couple the raw bitumen reservoir to the coupling member on the mill through the multiple valve system.

17. The apparatus of claim 1 including a separate aqueous bitumen emulsion reservoir tank.

* * * * *